US008059414B2

(12) United States Patent
Wei

(10) Patent No.: US 8,059,414 B2
(45) Date of Patent: Nov. 15, 2011

(54) MINIATURE PORTABLE MEMORY DEVICE

(75) Inventor: Chung-Yu Wei, Hsinchu (TW)

(73) Assignee: Yu Ge Wei International Corp., Hsinchu (TW)

( * ) Notice: Subject to any disclaimer, the term of this patent is extended or adjusted under 35 U.S.C. 154(b) by 344 days.

(21) Appl. No.: 12/458,888

(22) Filed: Jul. 27, 2009

(65) Prior Publication Data

US 2010/0046156 A1 Feb. 25, 2010

(30) Foreign Application Priority Data

Aug. 19, 2008 (TW) ..... 97214843 U

(51) Int. Cl.
*H05K 1/14* (2006.01)

(52) U.S. Cl. ..... 361/737

(58) Field of Classification Search ..... 361/730, 361/737, 752
See application file for complete search history.

(56) References Cited

U.S. PATENT DOCUMENTS 6,890,188 B1 * 5/2005 Le ..... 439/76.1
6,908,038 B1 * 6/2005 Le ..... 235/492
7,420,803 B2 * 9/2008 Hsueh et al. ..... 361/679.41
7,447,037 B2 * 11/2008 Hiew et al. ..... 361/737
7,909,251 B2 * 3/2011 Yi et al. ..... 235/451
2006/0023433 A1 * 2/2006 Lin ..... 361/752
2007/0047359 A1 * 3/2007 He et al. ..... 365/207
2008/0156871 A1 * 7/2008 Fidalgo et al. ..... 235/382

* cited by examiner

*Primary Examiner* — Lisa Lea Edmonds
*Assistant Examiner* — Xanthia C Cunningham
(74) *Attorney, Agent, or Firm* — Rosenberg, Klein & Lee

(57) ABSTRACT

Disclosed is a miniature portable memory device, comprising: a memory card unit; a shell, which is provided with a reception slot inside for receiving and accommodating said memory card unit, one end of said shell is provided with a first opening portion for insertion of said memory card unit into said reception slot, and a second opening portion is provided on said shell, so that when said memory card unit is inserted into said reception slot, said memory card unit is exposed to outside of said shell through said second opening portion; and a cover body, provided with a connection portion, that can be inserted into said first opening portion of said shell, and well fits therein. An indented portion is provided on one end of said first opening portion, and a protrusion portion is provided on said connection portion and corresponding to said indented portion, so that when said cover body is inserted into said first opening portion, said protrusion portion is inserted into said indented portion, such that when said cover body is inserted into and capped onto said shell, the engagement and connection can be much more tightly fit and secure.

4 Claims, 4 Drawing Sheets

MINIATURE PORTABLE MEMORY DEVICE

BACKGROUND OF THE INVENTION

1. Field of the Invention

The present invention relates to a portable storage device, and in particular to a miniature portable memory device.

2. The Prior Arts

With the increasing popularity of portable disk, portable disk is now widely accepted by the public for the convenience of its portability and fast data access, and it now has the tendency of gradually replacing CD players. As such, it is designed and developed toward high storage capacity, light weight, and thin profile for convenient carriage so as to meet customer's requirements. In general, a miniature portable disk is composed of a memory card unit and a shell. The shell is provided with reception slot therein for receiving and positioning the memory card unit, and is used to glue and fix a memory card into the reception slot by means of gluing. However, after long time usage, the gluing and adhesion tends to deteriorate, thus the memory card unit is liable to be detached from the reception slots.

By way of example, referring to Patent Number M326205 of ROC Taiwan, which shows an improved structure of a miniature portable memory device. Referring to FIG. 1 for a schematic diagram of a miniature portable memory device of the prior art. As shown in FIG. 1, a miniature portable memory device 10 includes: an outer shell 12, a reception slot 14 provided thereon for receiving and accommodating a memory card unit 16; a cover plate 18 provided at a top portion in a proper location of the reception slot 14, and is used to shield a portion of an area of the reception slot 14, thus when a memory card unit 16 is put in, it is fastened into the reception slot by means of the cover plate 18. However, this kind of design is still liable to have certain inconvenience, such as when inserting memory card unit in the reception slot, the memory card unit must be tilted to a certain angle to be put in the reception slot. The same condition exists when pulling a memory card unit out of a reception slot. In addition, in this design, the area shielded by the cover plate is rather too small, and that is liable to cause the slipping out of a memory card unit.

SUMMARY OF THE INVENTION

In view of the problems and shortcomings of the prior art, a major objective of the present invention is to provide a miniature portable memory device, so as to overcome the problems of the prior art.

A major objective of the present invention is to provide a miniature portable memory device, wherein, a first opening portion is provided on a shell, for allowing a memory card unit to be inserted into the memory device, and through inserting a cover body into and capping on the first opening portion, hereby facilitating the putting in and taking out of a memory card unit, and also providing effective protection for a memory card unit.

Another objective of the present invention is to provide a miniature portable memory device, wherein, a protrusion portion is provided on a cover body and corresponding to an indented portion on one end of a first opening portion, so that when a cover body is put on the shell, the engagement and connection can be much more tightly fit and secure.

In order to achieve the above mentioned objective, the present invention provides a miniature portable memory device, including a memory card unit; a shell, in which a reception slot is provided for receiving and accommodating the memory card unit, one end of the shell is provided with a first opening portion, that is used to allow the insertion of the memory card unit into the reception slot, in addition, a second opening portion is provided in the shell, so that when a memory card unit is inserted into the reception slot, the memory card unit is protruded out of the shell through the second opening portion; and a cover body, one side of which is provided with a connection portion, that can be inserted into a first opening portion on the shell and well fits therein, an indented portion is provided on one end of the first opening portion, and a protrusion portion is provided on the connection portion and corresponding to the indented portion, so that when the cover body is inserted into the first opening portion, the protrusion portion is inserted into the indented portion, as such, when the cover body is inserted into and capped onto the shell, the engagement and connection can be much more tightly fit and secure. Moreover, a number of insertion & connection terminals are provided on the memory card unit, so that when the memory card unit is inserted into the reception slot, the insertion & connection terminals are exposed to the outside through the second opening portion.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
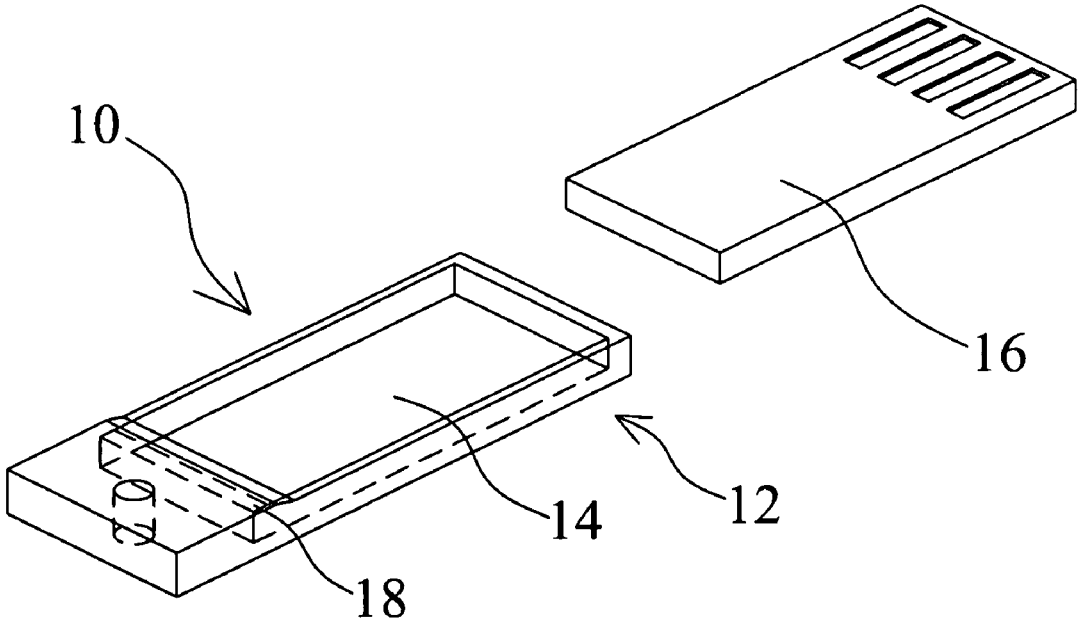
Fig. 1 (prior art)
FIG. 1 is a schematic diagram of a miniature portable memory device according to the prior art.
Figure 2A:
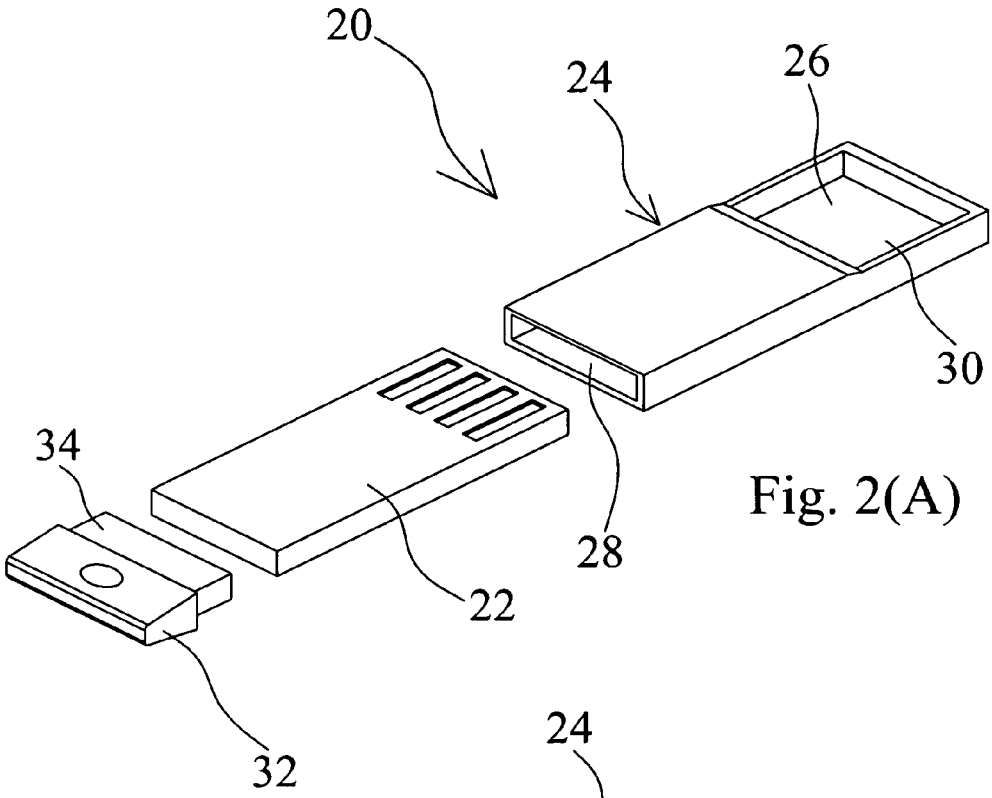
FIG. 2(A) is a perspective & exploded schematic diagram of a miniature portable memory device according to an embodiment of the present invention.
Figure 2B:
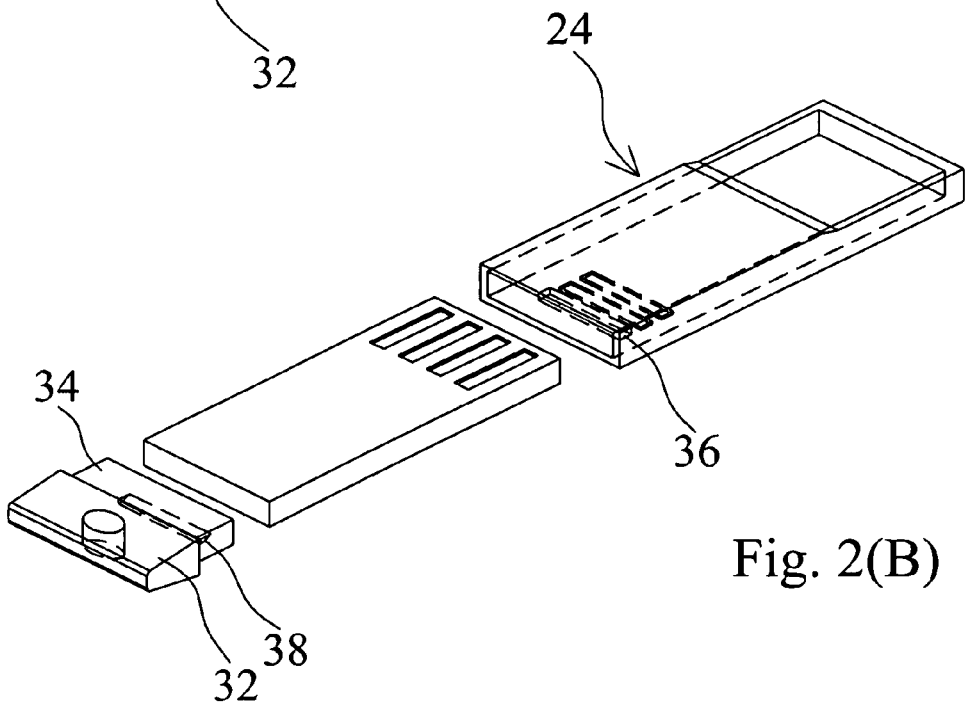
FIG. 2(B) is another perspective & exploded schematic diagram of a miniature portable memory device according to an embodiment of the present invention.

Firstly, referring to FIG. 2(A) for a perspective & exploded schematic diagram of a miniature portable memory device 20 according to an embodiment of the present invention. As shown in FIG. 2(A), a miniature portable memory device 20 includes: a memory card unit 22; a shell 24, which is provided with a reception slot 26 inside for receiving and accommodating a memory card unit 22, one end of shell 24 is provided with a first opening portion 28 for insertion of a memory card unit 22 into the reception slot 26, a second opening portion 30 is provided on shell 24, so that when memory card unit 22 is inserted into reception slot 26, the memory card unit 22 is exposed to the outside of shell 24 through the second opening portion 30; and a cover body 32, one end of the cover body 32 is provided with a connection portion 34, that can be inserted into the first opening portion 28 in a shell 24, and well fits therein. Next, referring to FIG. 2(B) for another perspective & exploded schematic diagram of a miniature portable memory device 20 according to an embodiment of the present invention. As shown in FIG. 2(B), in a miniature portable memory device 20, an indented portion 36 is provided on one end of the first opening portion 28, a protrusion portion 38 is provided on a connection portion 34 of a cover body 32, and is corresponding to an indented portion 36, so that when the cover body 32 is inserted into the first opening portion 28, the protrusion portion 38 is inserted into the indented portion 36. As such, when the cover body 32 is inserted into and capped onto the shell 24, the engagement and connection can be much more tightly fit and secure.

Figure 3:
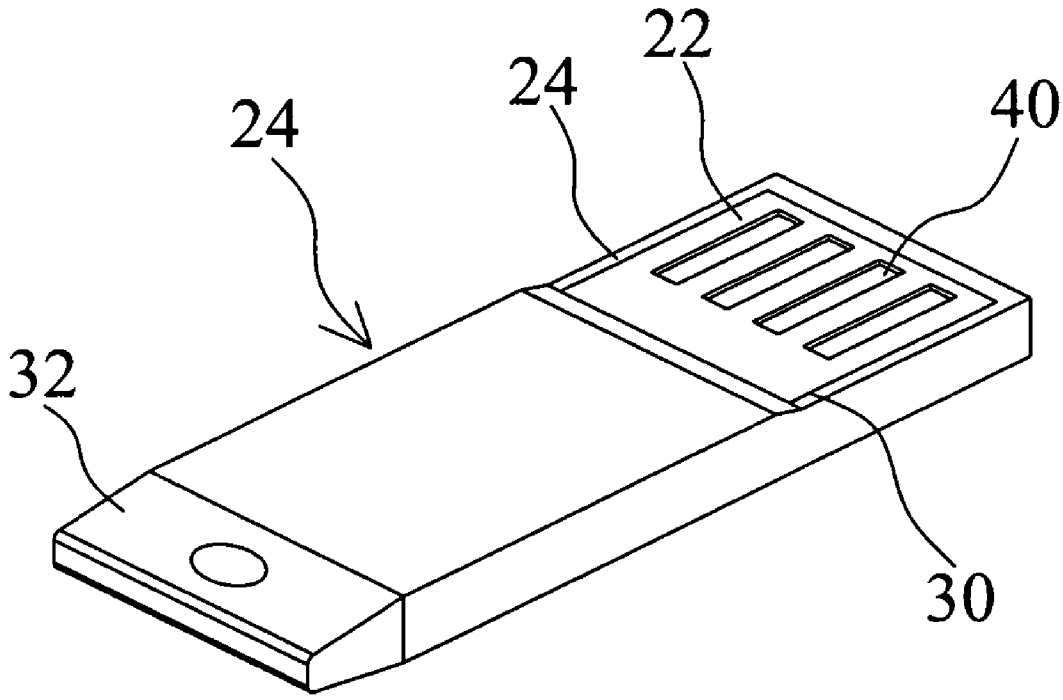
FIG. 3 is a schematic diagram of an assembled miniature portable memory device according to an embodiment of the present invention.

Subsequently, referring to FIG. 3 for a schematic diagram for an assembled miniature portable memory device according to an embodiment of the present invention. As shown in FIG. 3, a memory card unit 22 is inserted into a reception slot 26 inside a shell 24, one end of a memory card unit 22 is exposed to outside through a second opening portion 30, a number of insertion & reception terminals are provided on the a memory card unit 22, so that when the memory card unit 22 is inserted into the reception slot 26, the insertion terminals 40 are exposed to the outside through the second opening portion 30; and as such, the cover body 32 is connected with the shell 24.

Figure 4:
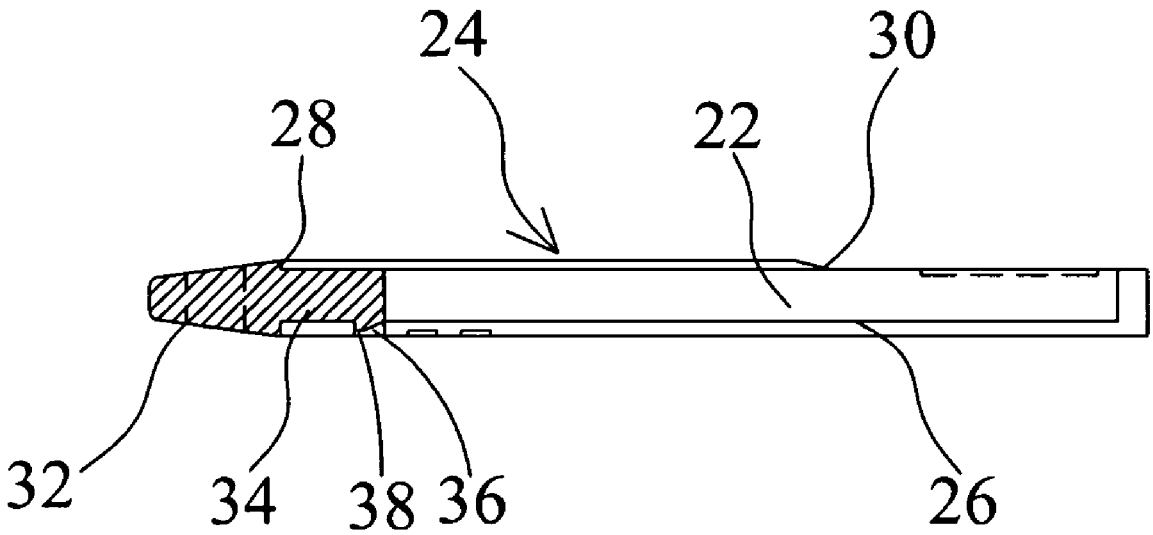
FIG. 4 is a cross section view of a miniature portable memory device according to an embodiment of the present invention.

Finally, referring to FIG. 4 for a cross section view of a miniature portable memory device according to an embodiment of the present invention. As shown in FIG. 4, a memory card unit 22 is placed and located in a reception slot 26, insertion & reception terminals 40 on a memory card unit 22 is exposed to the outside through a second opening portion 30; a connection portion 34 at one end of a cover body 32 is inserted into a first opening portion 28 in shell 24; and a protrusion portion 38 on a cover body 32 is inserted into an indented portion 36 of shell 24, so that when the cover body 32 is inserted into and capped onto the shell 24, the engagement and connection can be much more tightly fit and secure.

The major technical characteristics of the present invention are achieved through a first opening portion provided on a shell of a miniature portable memory device to allow the insertion of a memory card unit; and moreover, through inserting a cover body into and capping onto the first opening portion, thus not only the memory card unit can be protected, but it can also facilitate the inserting in and pulling out of a memory card unit from a shell. As such, a protrusion portion is provided on the shell, and is corresponding to an indented portion disposed on one end of the first opening portion, so that when the cover body is inserted into and capped onto the shell, the engagement and connection can be much more tightly fit and secure.

The above detailed description of the preferred embodiment is intended to describe more clearly the characteristics and spirit of the present invention. However, the preferred embodiments disclosed above is not intended to be any restrictions to the scope of the present invention. Conversely, its purpose is to include the various changes and equivalent arrangements which are within the scope of the appended claims.

What is claimed is:

1. A miniature portable memory device, comprising:

a memory card unit;

a shell, which is provided with a reception slot inside for receiving and accommodating said memory card unit, one end of said shell is provided with a first opening portion for insertion of said memory card unit into said reception slot, a second opening portion is provided in said shell, so that when said memory card unit is inserted into said reception slot, said memory card unit is exposed to outside of said shell through said second opening portion; and a cover body, one end of said cover body is provided with a connection portion, that can be inserted into said first opening portion of said shell, and well fits therein.

2. The miniature portable memory device as claimed in claim 1, wherein an indented portion is provided on one end of said first opening portion, a protrusion portion is provided on said connection portion and corresponding to said indented portion, so that when said cover body is inserted into said first opening portion, said protrusion portion is inserted into said indented portion.

3. The miniature portable memory device as claimed in claim 1, wherein a plurality of the insertion & connection terminals are provided on said memory card unit.

4. The miniature portable memory device as claimed in claim 3, wherein when said memory card unit is inserted into said reception slot, said insertion & connection terminals are exposed to outside through said second opening portion.

* * * * *